US010113450B2

(12) United States Patent
Suganuma et al.

(10) Patent No.: US 10,113,450 B2
(45) Date of Patent: Oct. 30, 2018

(54) VALVE OPENING AND CLOSING TIMING CONTROL APPARATUS

(71) Applicant: AISIN SEIKI KABUSHIKI KAISHA, Kariya-shi, Aichi-ken (JP)

(72) Inventors: Hideyuki Suganuma, Anjo (JP); Yuji Noguchi, Obu (JP); Takeo Asahi, Kariya (JP); Hiroyuki Hamasaki, Obu (JP); Toru Sakakibara, Kariya (JP); Tomohiro Kajita, Kariya (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 89 days.

(21) Appl. No.: 15/275,806

(22) Filed: Sep. 26, 2016

(65) Prior Publication Data

US 2017/0130621 A1 May 11, 2017

(30) Foreign Application Priority Data

Nov. 9, 2015 (JP) ..... 2015-219634

(51) Int. Cl.
*F01L 1/34* (2006.01)
*F15B 13/04* (2006.01)
(Continued)

(52) U.S. Cl.
CPC ..... *F01L 1/3442* (2013.01); *F01L 1/053* (2013.01); *F01L 1/34* (2013.01); *F02D 13/0219* (2013.01);
(Continued)

(58) Field of Classification Search
CPC ... F01L 1/3442; F01L 1/34; F01L 2001/3443; F01L 2001/34433; F01L 1/053;
(Continued)

(56) References Cited

U.S. PATENT DOCUMENTS 7,389,756 B2 6/2008 Hoppe et al.
2010/0175651 A1* 7/2010 Takenaka ..... F01L 1/022 123/90.17

(Continued)

FOREIGN PATENT DOCUMENTS

DE 10 2008 057 491 A1 5/2010
JP 2009-515090 A 4/2009
JP 2016-48043 A 4/2016

*Primary Examiner* — Mark Laurenzi
*Assistant Examiner* — Wesley Harris
(74) *Attorney, Agent, or Firm* — Buchanan Ingersoll & Rooney PC

(57) ABSTRACT

A valve opening and closing timing control apparatus includes: a driving side rotor synchronously rotating with a crankshaft of an engine; a driven side rotor disposed at a coaxial core with a rotary shaft core of the driving side rotor and integrally rotating with a camshaft for a valve opening and closing; a connecting bolt disposed at the coaxial core with the rotary shaft core to connect the driven side rotor to the camshaft, and on which an advance angle port and a retard angle port are formed on an outer peripheral surface; and a spool disposed in a spool chamber of the inside of the connecting bolt, and controlling the feeding and discharging of working fluid to the advance angle port or the retard angle port from a pump port formed on the connecting bolt.

5 Claims, 4 Drawing Sheets

(51) Int. Cl.
*F01L 1/053* (2006.01)
*F02D 13/02* (2006.01)
*F01L 1/344* (2006.01)

(52) U.S. Cl.
CPC ... *F15B 13/0402* (2013.01); *F01L 2001/0537* (2013.01); *F01L 2001/3443* (2013.01); *F01L 2001/34423* (2013.01); *F01L 2001/34426* (2013.01); *F01L 2001/34433* (2013.01); *F01L 2001/34483* (2013.01); *F01L 2201/00* (2013.01)

(58) Field of Classification Search
CPC ..... F01L 2001/0537; F01L 2001/34423; F01L 2001/34426; F01L 2001/34483; F01L 2201/00; F15B 13/0402; F02D 13/0219
USPC ..... 123/90.15–90.17
See application file for complete search history.

(56) References Cited

U.S. PATENT DOCUMENTS

2012/0097122 A1 4/2012 Lichti
2015/0059669 A1* 3/2015 Yamakawa ..... F10L 1/3442 123/90.15

* cited by examiner

VALVE OPENING AND CLOSING TIMING CONTROL APPARATUS

CROSS REFERENCE TO RELATED APPLICATIONS

This application is based on and claims priority under 35 U.S.C. § 119 to Japanese Patent Application 2015-219634, filed on Nov. 9, 2015, the entire contents of which are incorporated herein by reference.

TECHNICAL FIELD

This disclosure relates to a valve opening and closing timing control apparatus.

BACKGROUND DISCUSSION

JP 2009-515090T (Reference 1), US 2012/0097122A1 (Reference 2), and DE 102008057491A1 (Reference 3) disclose a valve opening and closing timing control apparatus provided with a cylindrical bolt that connects a driven side rotor and a camshaft, and disposed with an introduction passage along a longitudinal direction of a rotary shaft core as a flow passage that supplies a working fluid to an advance angle chamber and a retard angle chamber.

In References 1 to 3, the valve opening and closing timing control apparatus is configured such that an advance angle communication passage and a retard angle communication passage are disposed to pass through a bolt in a direction intersecting the rotary shaft core, and the working fluid flows separately into an advance angle flow passage and a retard angle flow passage. The advance angle communication passage and the retard angle communication passage are disposed at different positions along a circumferential direction of the rotary shaft core to the introduction passage, and at different positions along the longitudinal direction of the rotary shaft core. A control valve body reciprocating along the rotary shaft core is disposed in the inside of the bolt, and the working fluid from the introduction passage is supplied by switching to the advance angle communication passage or the retard angle communication passage, depending on the position of the control valve body.

In a valve opening and closing timing control apparatus described in Reference 1, a cylindrical member (sleeve) for forming an introduction passage (compression medium passage) to and from a bolt (valve housing) is disposed between the bolt and a control valve body (control piston) at the inner side of the bolt.

According to such a configuration, the cylindrical member easily wears in accordance with reciprocating movement of the control valve body, sealing performance of an interface between the control valve body and the cylindrical member is reduced, and working fluid easily leaks out from the interface between the control valve body and the cylindrical member. In a case where the working fluid leaks out from the interface between the control valve body and the cylindrical member, the speed of supply of the working fluid to an advance angle chamber or a retard angle chamber is reduced, and control responsiveness of the relative rotational phase is degraded in some cases.

In the valve opening and closing timing control apparatus described in Reference 2, the cylindrical member formed with the introduction passage therein is disposed between the bolt and a driven side rotor at the outer side of the bolt.

In this configuration, wear caused by the reciprocating movement of the control valve body does not occur in the cylindrical member, and leakage of the working fluid due to the decrease of the sealing performance is unlikely to occur. However, because an annular groove, a supply passage of a through hole for allowing communication with the annular groove, and an advance angle passage or a retard angle passage for allowing communication with the annular groove are disposed on a cylindrical wall portion of the cylindrical member, manufacture of the cylindrical member is complicated.

In the valve opening and closing timing control apparatus described in Reference 3, the cylindrical member formed with the introduction passage therein is disposed between the bolt and the driven side rotor at the outer side of the bolt.

In this configuration, wear caused by the reciprocating movement of the control valve body does not occur in the cylindrical member, and leakage of the working fluid due to decrease of the sealing performance is unlikely to occur. However, due to a structure in which a force fastening the driven side rotor to a camshaft is applied to the cylindrical member, deformation of the cylindrical member is likely to occur. In a case where the cylindrical member is deformed, the working fluid leaks out from the interface between the control valve body and the cylindrical member, the speed of supply of the working fluid to the advance angle chamber or the retard angle chamber is reduced, and the control responsiveness of the relative rotational phase is degraded.

SUMMARY

Thus, a need exists for a valve opening and closing timing control apparatus which is not suspectable to the drawback mentioned above.

A valve opening and closing timing control apparatus according to an aspect of this disclosure may include a driving side rotor that synchronously rotates with a crankshaft of an internal combustion engine, a driven side rotor that is disposed at a coaxial core with a rotary shaft core of the driving side rotor and integrally rotates with a camshaft for a valve opening and closing, a connecting bolt that is disposed at the coaxial core with the rotary shaft core to connect the driven side rotor to the camshaft, and on which an advance angle port communicating with an advance angle chamber partitioned between the driving side rotor and the driven side rotor and a retard angle port communicating with a retard angle chamber partitioned between the driving side rotor and the driven side rotor are formed on an outer peripheral surface, and a spool that is disposed in a spool chamber of the inside of the connecting bolt, and controls the feeding and discharging of working fluid to the advance angle port or the retard angle port from a pump port formed on the connecting bolt. The connecting bolt may be configured to include a bolt body to be connected to the driven side rotor and a sleeve externally fitting to the bolt body. The pump port may be formed as a through hole over the spool chamber and the outer peripheral surface on the bolt body, and the advance angle port and the retard angle port may be formed as a through hole over the bolt body and the sleeve. An inside space of the shaft to which the working fluid may be supplied from a fluid pressure pump is formed in the camshaft, and one end portion of the sleeve of the connecting bolt to be connected to the camshaft is exposed to the inside space of the shaft. An introduction flow passage for supplying the working fluid from the inside space of the shaft to the pump port may be formed to a region avoiding the advance angle port and the retard angle port on at least any one of an inner peripheral surface of the sleeve and the outer peripheral surface of the bolt body. The apparatus may further include a regulation mechanism which regulates a posture of rotation around the rotary shaft core of the bolt body and the sleeve, while allowing movement to abut on a portion of the driven side rotor in a direction along the rotary shaft core of the sleeve to the bolt body.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment disclosed here will be described with reference to drawings.

Basic Configuration

Figure 1:
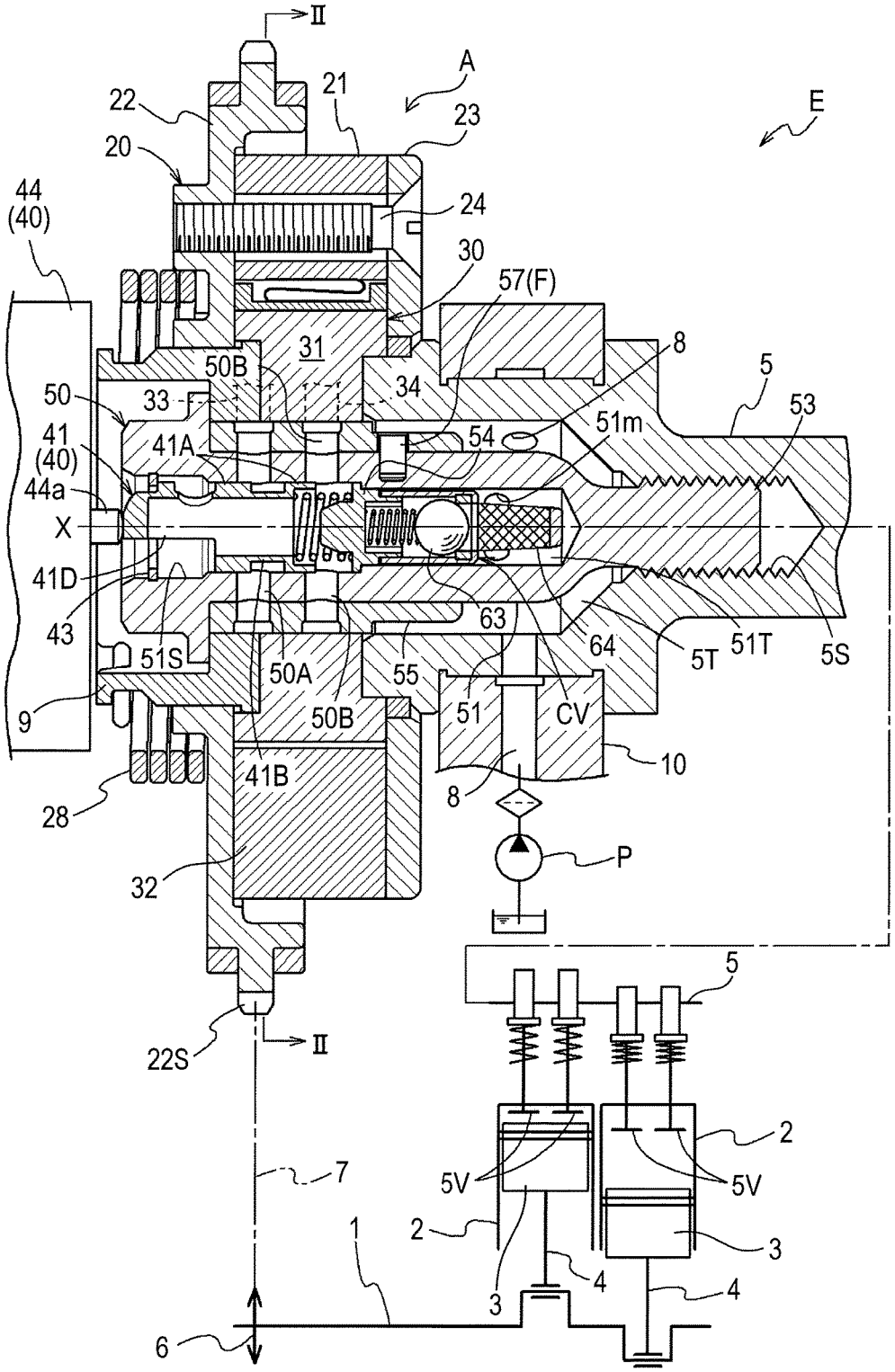
FIG. 1 is a cross-sectional view illustrating an entire configuration of a valve opening and closing timing control apparatus.
Figure 2:
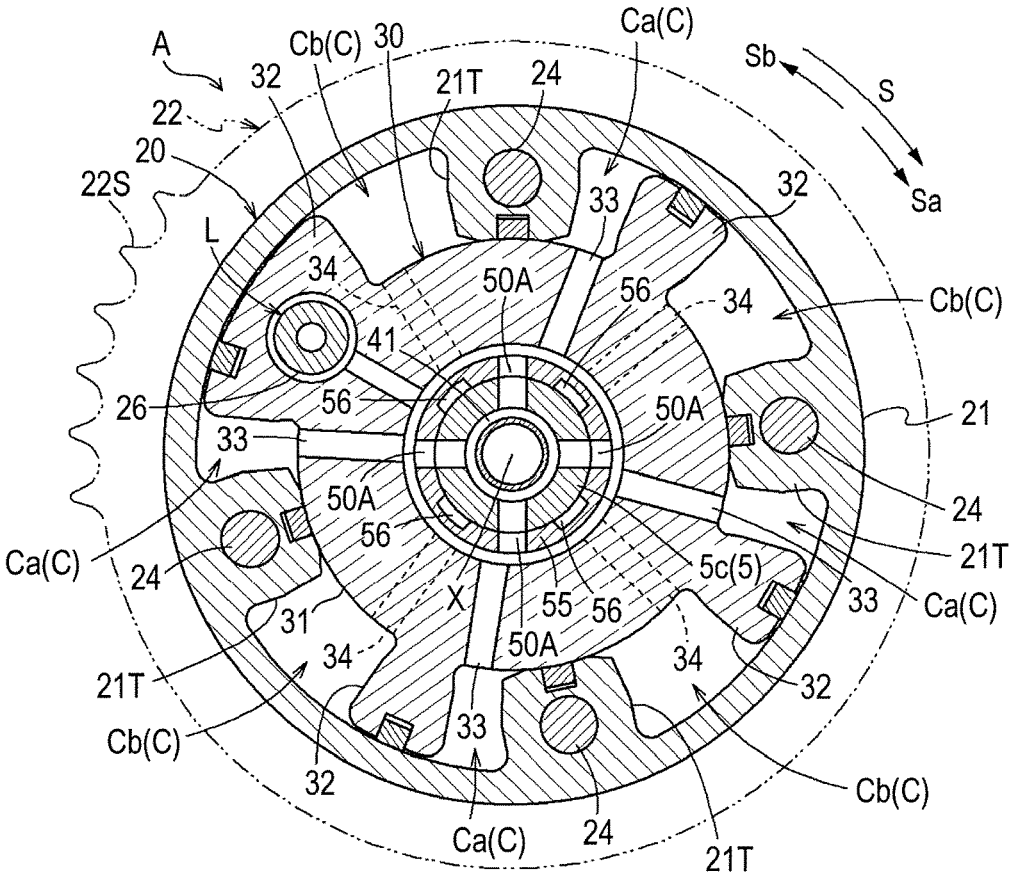
FIG. 2 is a cross-sectional view taken along line II-II in FIG. 1.
Figure 3:
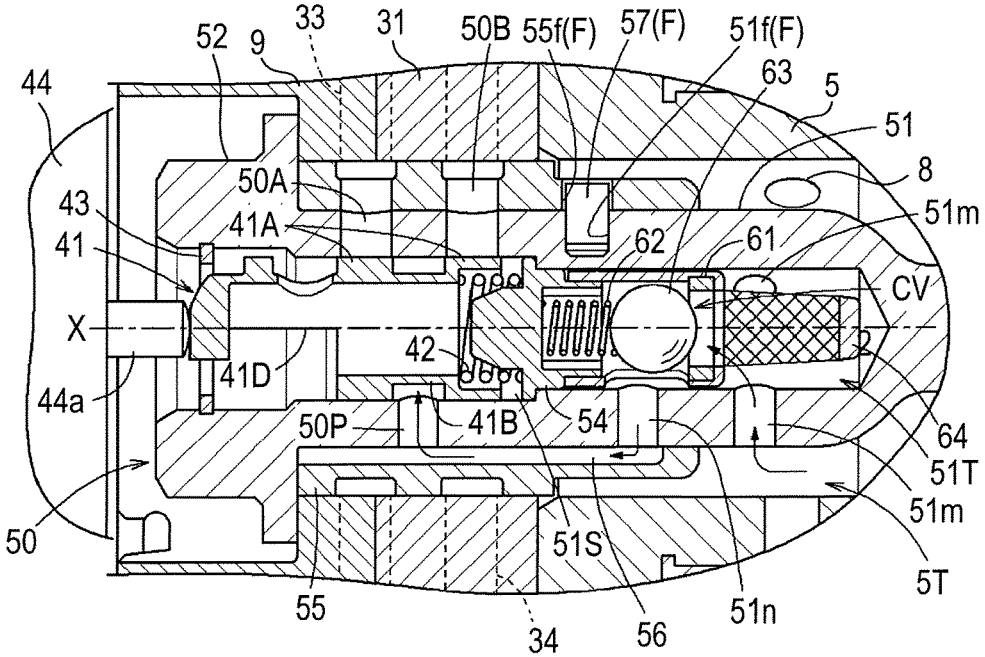
FIG. 3 is a cross-sectional view illustrating a spool in a neutral position.

As illustrated in FIG. 1 to FIG. 3, a valve opening and closing timing control apparatus A is configured to include an external rotor 20 as a driving side rotor, an internal rotor 30 as a driven side rotor, and a solenoid control valve 40 controlling a hydraulic oil as a working fluid.

The internal rotor 30 (one example of the driven side rotor) is disposed at a coaxial core with a rotary shaft core X of an intake camshaft 5, and is screwed and connected to the intake camshaft 5 by a connecting bolt 50 so as to rotate integrally. The external rotor 20 (one example of the driving side rotor) is disposed on the coaxial core with the rotary shaft core X, and is relatively rotatably supported to the internal rotor 30 by containing the internal rotor 30. This external rotor 20 synchronously rotates with a crankshaft 1 of an engine E as an internal combustion engine.

The solenoid control valve 40 is provided with an electromagnetic solenoid 44 supported by the engine E, and is provided with a spool 41 and a spool spring 42 accommodated in a spool chamber 51S of the connecting bolt 50.

The electromagnetic solenoid 44 is provided with a plunger 44*a* disposed at the coaxial core with the rotary shaft core X so as to abut on an outer end portion of the spool 41, and sets the amount of projection of the plunger 44*a* to set an operation position of the spool 41 by control of electric power to be supplied to a solenoid inside thereof. Thereby, a relative rotational phase of the external rotor 20 and the internal rotor 30 is set by controlling the hydraulic oil (one example of the working fluid), and control of an opening and closing timing of an intake valve 5V is realized.

Engine and the Valve Opening and Closing Timing Control Apparatus

The engine E (one example of the internal combustion engine) of FIG. 1 indicates that is provided in the vehicle such as a passenger car. This engine E accommodates a piston 3 in the inside of a cylinder bore in a cylinder block 2 of the upper position, and is configured with four-cycle type to connect the piston 3 and the crankshaft 1 with a connecting rod 4. The intake camshaft 5 opening and closing the intake valve 5V and an exhaust camshaft (not illustrated) are provided in upper side of the engine E.

In an engine constituting member 10 rotatably supporting the intake camshaft 5, a supply flow passage 8 is formed to supply the hydraulic oil from a hydraulic pump P (one example of the fluid pressure pump) driven by the engine E. The hydraulic pump P supplies lubricating oil stored in the oil pan of the engine E to the solenoid control valve 40 as the hydraulic oil (one example of the working fluid) via the supply flow passage 8.

A timing chain 7 is wound over an output sprocket 6 formed in the crankshaft 1 of the engine E and a timing sprocket 22S of the external rotor 20. Thereby, the external rotor 20 synchronously rotates with the crankshaft 1. A sprocket is provided to the front end of the exhaust camshaft of exhaust side and the timing chain 7 is wound in this sprocket.

As illustrated in FIG. 2, the external rotor 20 rotates toward a driving rotational direction S by the driving force from the crankshaft 1. The direction in which the internal rotor 30 is relatively rotated in the same direction as the driving rotational direction S with respect to the external rotor 20 is referred to as an advance angle direction Sa, and the reverse direction thereof is referred to as a retard angle direction Sb. In this valve opening and closing timing control apparatus A, relationship between the crankshaft 1 and the intake camshaft 5 is set so as to increase an intake air compression ratio in accordance with increase of the amount of displacement when the relative rotational phase is displaced in the advance angle direction Sa, and so as to reduce the intake air compression ratio in accordance with the increase of the amount of displacement when the relative rotational phase is displaced in the retard angle direction Sb.

Although the valve opening and closing timing control apparatus A is provided in the intake camshaft 5 in this embodiment, the valve opening and closing timing control apparatus A may be provided in the exhaust camshaft, or may be provided in both of the intake camshaft 5 and the exhaust camshaft.

The external rotor 20 includes an external rotor main body 21, a front plate 22, and a rear plate 23, and these portions are integrated by engagement of a plurality of fastening bolts 24. The timing sprocket 22S is formed on an outer periphery of the front plate 22. An annular member 9 is disposed on an inner periphery of the front plate 22 and a bolt head 52 of the connecting bolt 50 is crimped with respect to this annular member 9. Therefore, this annular member 9, an internal rotor main body 31, and the intake valve 5V are integrated.

Configuration of the Rotor

A plurality of projecting portions 21T projecting towards the inside in a radial direction is integrally formed in the external rotor main body 21. The internal rotor 30 includes the cylindrical internal rotor main body 31 which is brought into close contact with the projecting portion 21T of the external rotor main body 21, and four vane portions 32 which project towards the outside in the radial direction from the outer periphery of the internal rotor main body 31 so as to come into contact with an inner peripheral surface of the external rotor main body 21.

Thereby, the external rotor 20 contains the internal rotor 30 and a plurality of fluid pressure chambers C are formed on the outer periphery side of the internal rotor main body 31 at an intermediate position of the projecting portion 21T adjacent to each other in the rotation direction. These fluid pressure chambers C are partitioned by the vane portion 32, and an advance angle chamber Ca and a retard angle chamber Cb are partitioned and formed. An advance angle flow passage 33 communicating with the advance angle chamber Ca is formed in the internal rotor 30, and a retard angle flow passage 34 communicating with the retard angle chamber Cb is formed in the internal rotor 30.

As illustrated in FIG. 1, a torsion spring 28 assisting a displacement of the relative rotational phase between the external rotor 20 and the internal rotor 30 (hereinafter, referred to as the relative rotational phase) to the advance angle direction Sa by the action of biasing force from most retarded angle phase to the advance angle direction Sa is provided over the external rotor 20 and the annular member 9.

A locking mechanism L locking (fixing) the relative rotational phase between the external rotor 20 and the internal rotor 30 in the most retarded angle phase is provided. This locking mechanism L is configured to be provided with a locking member 26 supported freely movable in the direction along the rotary shaft core X with respect to the one vane portion 32, a locking spring (not illustrated) projecting and biasing this locking member 26, and a locking recess portion (not illustrated) formed on the rear plate 23. The locking mechanism L may be configured to be provided with the locking member 26 guided so as to be moved along the radial direction.

The relative rotational phase reaches the most retarded angle phase. Therefore, the locking member 26 is engaged with the locking recess portion by the biasing force of the locking spring, and this locking mechanism L serves to maintain the relative rotational phase to the most retarded angle phase. In a case where the advance angle flow passage 33 communicates with the locking recess portion, and the hydraulic oil is supplied to the advance angle flow passage 33, the locking mechanism L is also configured to perform lock releasing to detach the locking member 26 from the locking recess portion by a hydraulic oil pressure.

Connecting Bolt

As illustrated in FIG. 1 to FIG. 6, the connecting bolt 50 is provided with a bolt body 51 of which a portion is cylindrical, a cylindrical sleeve 55 fitted in a cylindrical portion of the bolt body 51, and a regulation mechanism F including an engagement pin 57 as an engagement member positioning these portions.

In the intake camshaft 5, a female threaded portion 5S is formed around the rotary shaft core X and an inside space of the shaft 5T as a larger diameter than the female threaded portion 5S is formed so that the sleeve 55 is tightly fitted. The inside space of the shaft 5T communicates with the supply flow passage 8 as described above. The hydraulic oil is supplied from the hydraulic pump P to the inside space of the shaft 5T.

The bolt head 52 is formed on the outer end portion of the bolt body 51 and a male threaded portion 53 is formed on an inner end portion. Based on this configuration, the male threaded portion 53 of the bolt body 51 is screwed to the female threaded portion 5S of the intake camshaft 5, and the internal rotor 30 is fastened to the intake camshaft 5 by rotational operation of the bolt head 52. In this fastening state, an inner end side of the outer periphery (male screw side) of the sleeve 55 being fitted in the bolt body 51 is in close contact with the inner peripheral surface of the inside space of the shaft 5T, and an outer peripheral surface of an outer end side (bolt head side) of the sleeve 55 is in close contact with the inner peripheral surface of the internal rotor main body 31.

In the inside of the bolt body 51, an hole-shaped internal space is formed in the direction of the male threaded portion 53 from the bolt head 52 and a retainer 54 to be press-fitted and fixed to this internal space. Therefore, the internal space is divided by the retainer 54, and the spool chamber 51S and a hydraulic oil chamber 51T as a fluid chamber are formed in the non-communicated state.

The spool chamber 51S is formed in a cylinder inner surface shape and the spool 41 as described above is reciprocally movably accommodated along the rotary shaft core X in the spool chamber 51S. Therefore, the spool spring 42 is disposed between the inside end of this spool 41 and the retainer 54. Thereby, the spool 41 is biased so as to project in the direction of the outer end side (direction of the bolt head 52).

In the bolt body 51, a plurality of acquisition flow passages 51*m* communicating the hydraulic oil chamber 51T (one example of the fluid chamber) and the inside space of the shaft 5T are formed, and a plurality of intermediate flow passages 51*n* are formed between the hydraulic oil chamber 51T and the outer peripheral surface of the bolt body 51.

A check valve CV is provided in the flow passage sending the hydraulic oil from the acquisition flow passage 51*m* to the intermediate flow passage 51*n* in the hydraulic oil chamber 51T. This check valve CV is configured with a ball holder 61, a check spring 62, and a check ball 63.

In this check valve CV, the check spring 62 is disposed between the retainer 54 and the check ball 63, and the check ball 63 is in pressure contact with an opening of the ball holder 61 by the biasing force of the check spring 62 to close the flow passage. An oil filter 64 removing dust from the hydraulic oil flowing toward the check ball 63 is provided in the ball holder 61.

In a case where the pressure of the hydraulic oil supplied to the hydraulic oil chamber 51T exceeds a predetermined value, the check valve CV opens the flow passage against the biasing force of the check spring 62. In a case where the pressure is decreased less than the predetermined value, the check valve CV closes the flow passage by the biasing force of the check spring 62. By this operation, when the pressure of the hydraulic oil is decreased, reverse flow of the hydraulic oil from the advance angle chamber Ca or the retard angle chamber Cb is prevented, and variation of the phase of the valve opening and closing timing control apparatus A is suppressed. Even in a case where the pressure of a downstream side of the check valve CV exceeds a predetermined value, this check valve CV performs closing operation.

Solenoid Control Valve

As described above, the solenoid control valve 40 is provided with the spool 41, the spool spring 42, and the electromagnetic solenoid 44.

A plurality of pump ports 50P communicating the spool chamber 51S and the outer peripheral surface of the bolt body 51 are formed as a through hole in the bolt body 51. A plurality of advance angle ports 50A and a plurality of retard angle ports 50B communicating the spool chamber 51S and the outer peripheral surface of the sleeve 55 are formed as the through hole over the bolt body 51 and the sleeve 55 in the connecting bolt 50.

The advance angle port 50A, the pump port 50P, and the retard angle port 50B are disposed in the inner end side from the outer end side of the connecting bolt 50 in this order. The advance angle port 50A and the retard angle port 50B in the direction as viewed along the rotary shaft core X are formed in the overlapping positions with each other, and the pump port 50P is formed in a position that does not overlap with these ports.

On the outer periphery of the sleeve 55, an annular groove is formed with which the plurality of advance angle ports 50A communicate, and the plurality of advance angle ports 50A communicate with a plurality of the advance angle flow passages 33 from the annular groove. In the same way, on the outer periphery of the sleeve 55, an annular groove is formed with which the plurality of retard angle ports 50B communicate, and the plurality of retard angle ports 50B communicate with a plurality of the retard angle flow passages 34 from the annular groove. Furthermore, an introduction flow passage 56 communicating the intermediate flow passage 51*n* and the pump port 50P is formed in a groove shape on the inner peripheral surface of the sleeve 55.

That is, the sleeve 55 is shaped at a dimension reaching a position covering the intermediate flow passage 51*n* from the bolt head 52 of the bolt body 51, and the introduction flow passage 56 is formed in a region avoiding the advance angle port 50A and the retard angle port 50B.

A first engagement portion 51*f* is formed as a bag-shaped hole at a position deviated from a press-fitted and fixed position of the retainer 54 in the direction along the rotary shaft core X in the bolt body 51, and a hole-shaped second engagement portion 55*f* penetrating in the radial direction is formed in the sleeve 55. Therefore, the regulation mechanism F is configured to be provided with the engagement pin 57 (one example of the engagement member) engaging with these portions. The engagement pin 57 is press-fitted and fixed to the first engagement portion 51*f*.

Specifically, the second engagement portion 55*f* is formed in a long hole shape of which the direction along the rotary shaft core X is larger than the direction perpendicular to the direction thereof in this regulation mechanism F. Based on this configuration, a gap allowing a relative movement in the direction along the rotary shaft core X of the bolt body 51 and the sleeve 55 is formed between the second engagement portion 55*f* and the engagement pin 57.

That is, while maintaining a relative posture of rotation around the rotary shaft core X of the bolt body 51 and the sleeve 55, the sleeve 55 is configured to be movable with respect to the bolt body 51 by an amount corresponding to the gap between the second engagement portion 55*f* and the engagement pin 57 in the direction along the rotary shaft core X. Thereby, by the pressure of the hydraulic oil being applied to an end portion of the sleeve 55 from the hydraulic oil chamber 51T, all of the sleeve 55 is moved in the direction of the outer end side and the end portion of the outer end side of this sleeve 55 is moved until the end portion abuts on a rear surface of the bolt head 52 (portion of the driven side rotor) of the bolt body 51 being in close contact with the rear surface. Therefore, the leakage of the hydraulic oil at this portion may be suppressed.

This regulation mechanism F is provided, so that the relative posture of rotation around the rotary shaft core X of the bolt body 51 and the sleeve 55, and the relative position thereof in the direction along the rotary shaft core X are determined. Accordingly, the hydraulic oil of the hydraulic oil chamber 51T is supplied to the pump port 50P via the acquisition flow passage 51*m*, the check valve CV, the intermediate flow passage 51*n*, and the introduction flow passage 56.

The regulation mechanism F is not limited to this configuration, for example, the first engagement portion 51*f* is formed in the long hole shape of which the direction along the rotary shaft core X is long or is in the small diameter only by a region abutting on the second engagement portion 55*f* of the engagement pin 57. Therefore, the sleeve 55 may be configured to be capable of moving slightly in the direction along the rotary shaft core X with respect to the bolt body 51.

The spool 41 forms an abutting surface on which the plunger 44*a* abuts on the outer end side, forms land portions 41A at two positions in the direction along the rotary shaft core X, and forms a groove portion 41B at an intermediate position of these land portions 41A. This spool 41 is formed in a hollow, and a drain hole 41D is formed on a projecting end of the spool 41. The spool 41 abuts on a stopper 43 provided on an inner peripheral opening of the outer end side of the connecting bolt 50, so that a position of a projecting side is determined.

The solenoid control valve 40 causes the plunger 44*a* to abut on the abutting surface of the spool 41, and controls the amount of projection. Therefore, as illustrated in FIG. 3, FIG. 4, and FIG. 5, the solenoid control valve 40 is configured to be capable of setting the spool 41 at a neutral position, a retard angle position, and an advance angle position.

The spool 41 is set at the neutral position illustrated in FIG. 3, so that the advance angle port 50A and the retard angle port 50B are closed at the same time by a pair of the land portions 41A of the spool 41. As a result, the feeding and discharging of the hydraulic oil to the advance angle chamber Ca and the retard angle chamber Cb are not preformed, and the phase of the valve opening and closing timing control apparatus A is maintained.

Figure 4:
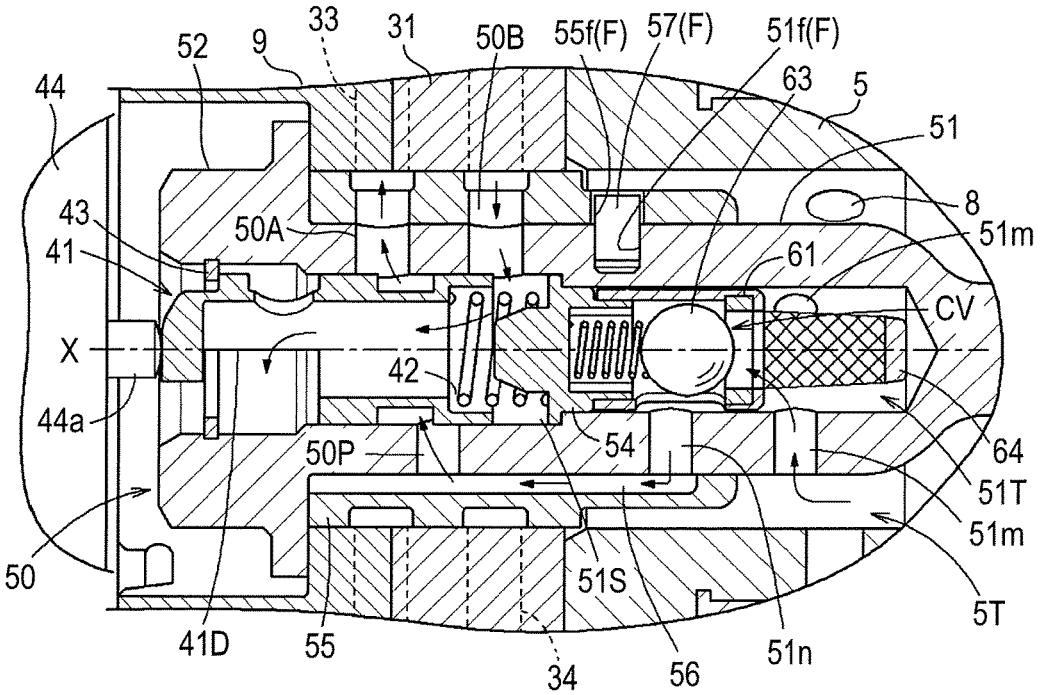
FIG. 4 is a cross-sectional view illustrating a spool in an advance angle position.
Figure 5:
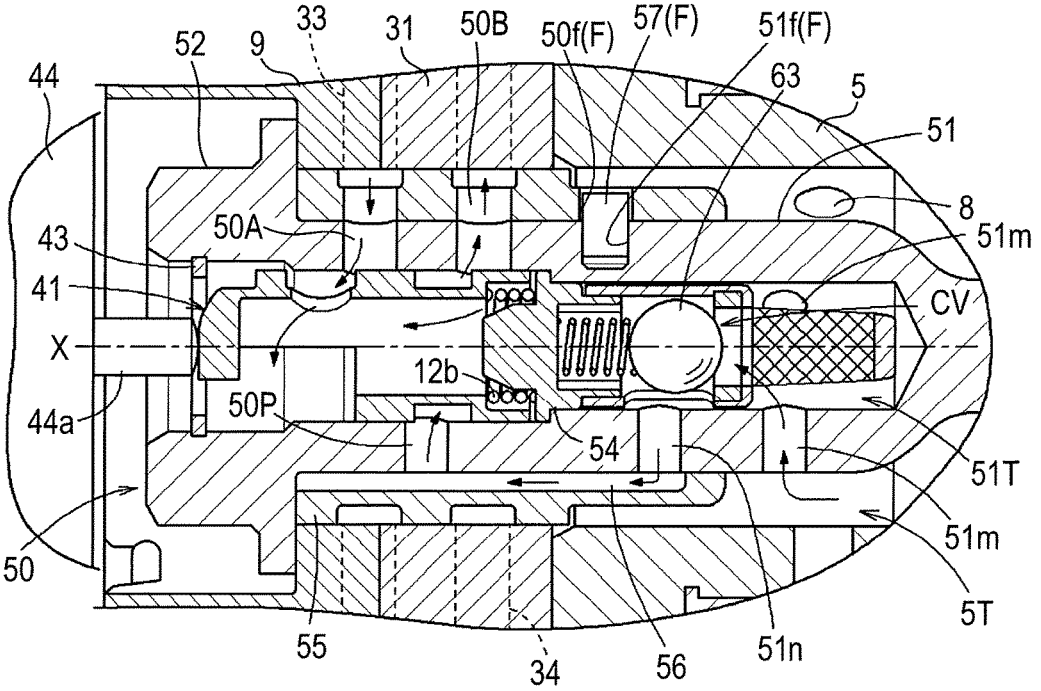
FIG. 5 is a cross-sectional view illustrating a spool in a retard angle position.
Figure 6:
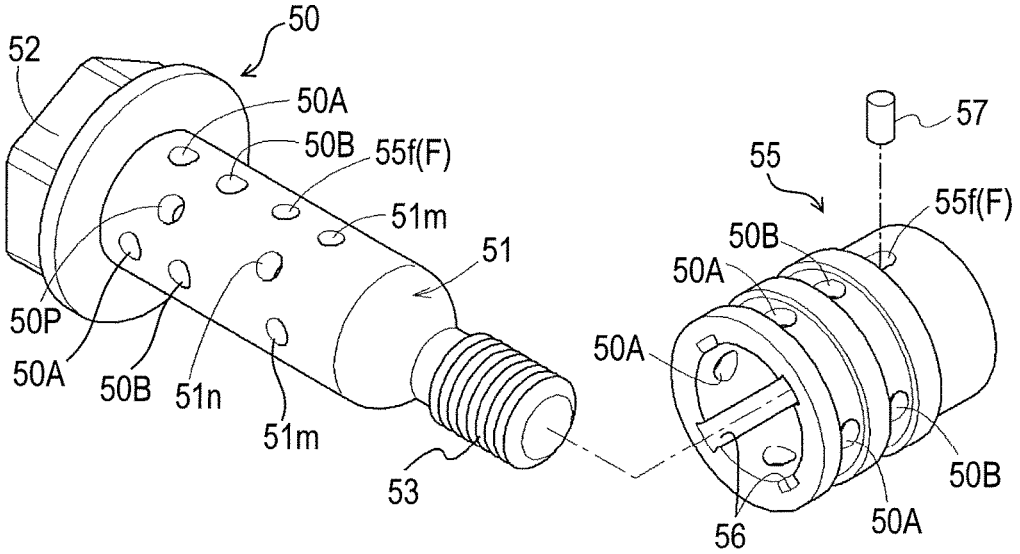
FIG. 6 is a disassembled perspective view illustrating a bolt body and a sleeve.

The plunger 44*a* is retracted (operated outwards) on the basis of the neutral position by the control of the electromagnetic solenoid 44, so that the spool 41 is set at the advance angle position illustrated in FIG. 4. The pump port 50P communicates with the advance angle port 50A via the groove portion 41B at this advance angle position. At the same time, the retard angle port 50B communicates with the spool chamber 51S from the inner end of the spool 41. Thereby, the hydraulic oil is supplied to the advance angle chamber Ca, the hydraulic oil of the retard angle chamber Cb flows in the inside of the spool 41, and the hydraulic oil is discharged from the drain hole 41D (flow of the hydraulic oil is illustrated by an arrow in FIGS. 3 to 5). As a result, rotation phase of the intake camshaft 5 is displaced in the advance angle direction Sa. This advance angle position coincides with the position in which the spool 41 abuts on the stopper 43 by the biasing force of the spool spring 42.

In a state where the locking mechanism L is in a lock state, the spool 41 is set at the advance angle position. In a case where the hydraulic oil is supplied to the advance angle flow passage 33, the hydraulic oil is supplied to the locking recess portion of the locking mechanism L from the advance angle flow passage 33. Therefore, the locking member 26 is detached from this locking recess portion, and the lock state of the locking mechanism L is released.

The plunger 44*a* is projected (operated inwards) on the basis of the neutral position by the control of the electromagnetic solenoid 44, so that the spool 41 is set at the retard angle position illustrated in FIG. 5. The pump port 50P communicates with the retard angle port 50B via the groove portion 41B at this retard angle position. At the same time, the advance angle port 50A is communicated with a drain space (space continued to the outer end side from the spool chamber 51S). Thereby, at the same time the hydraulic oil is supplied to the retard angle chamber Cb, the hydraulic oil is discharged from the advance angle chamber Ca (flow of the hydraulic oil is illustrated by the arrow in FIGS. 3 to 5). As a result, the rotation phase of the intake camshaft 5 is displaced in the retard angle direction Sb.

Action and Effect of the Embodiment

Since the solenoid control valve 40 of the valve opening and closing timing control apparatus A is provided with the spool 41 in the inside of the connecting bolt 50 in this manner, the feeding and discharging of the hydraulic oil to the advance angle chamber Ca and the retard angle chamber Cb of the valve opening and closing timing control apparatus A are in the form controlling from a position close to the advance angle chamber Ca and the retard angle chamber Cb. Therefore, the rapid control of the opening and closing timing is rapidly performed.

In this configuration, since the introduction flow passage 56 is formed on the inner peripheral surface of the sleeve 55, for example, it is unnecessary to perform complicated processing that requires accuracy, such as to form the supply flow passage by drilling on the bolt body 51, and assembly is also easy.

Since the inner end of the sleeve 55 is configured to be exposed to the inside space of the shaft 5T, the pressure of the hydraulic oil of the inside space of the shaft 5T applies as force displacing the sleeve 55 in the direction of the bolt head 52. The sleeve 55 is configured to be capable of relatively moving slightly in the direction along the rotary shaft core X with respect to the bolt body 51 in the regulation mechanism F. Thereby, the end portion of the projecting side of the sleeve 55 may come into close contact with the rear surface of the bolt head 52 by the pressure of the hydraulic oil, and a sealing performance of a close contact surface is improved, without using an oil seal.

Specifically, even the introduction flow passage 56 is configured to reach the outer end side in the sleeve 55, since the end portion of the sleeve 55 may come into close contact with the rear surface of the bolt head 52 by the pressure of the hydraulic oil, the inconvenience that the hydraulic oil leaks from the end portion of the sleeve 55 may be suppressed.

Other Embodiment

The embodiment disclosed here may be configured as follows except for the above-described embodiment (those having the same functions as the embodiment are designated with the common numbers and reference numerals as the embodiment).

(a) The introduction flow passage 56 is formed on the outer peripheral surface of the bolt body 51, or the introduction flow passage 56 is formed on both of the inner peripheral surface of the sleeve 55 and the outer peripheral surface of the bolt body 51. Specifically, in the configuration forming the introduction flow passage 56 on both of the inner peripheral surface of the sleeve 55 and the outer peripheral surface of the bolt body 51, the sufficient amount of the hydraulic oil may be obtained.

Figure 7:
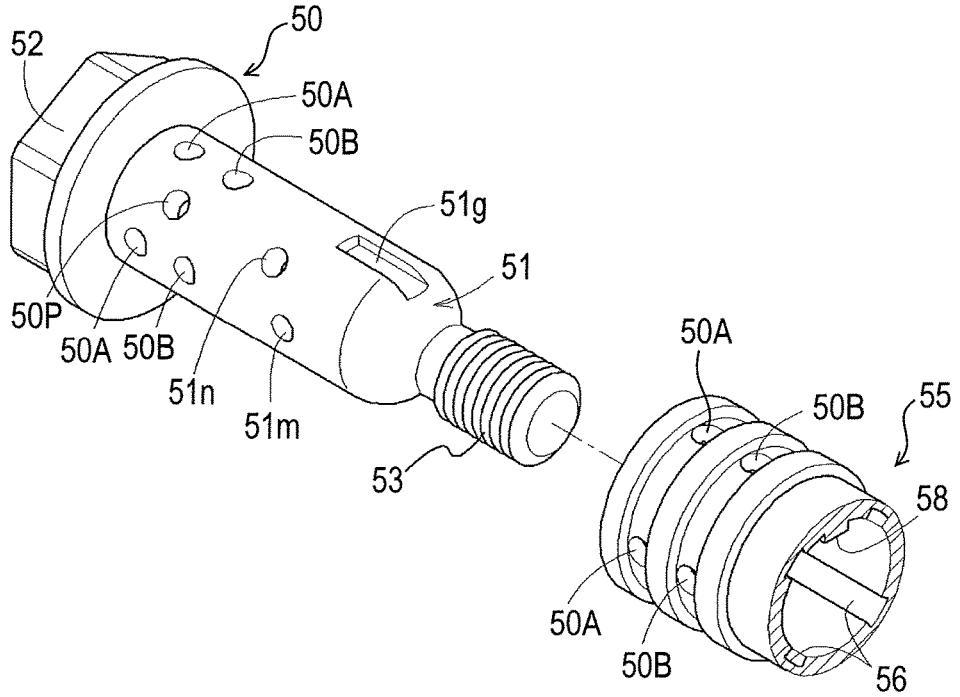
FIG. 7 is a disassembled perspective view illustrating a bolt body and a sleeve according to the other embodiment (b).

(b) As illustrated in FIG. 7, the regulation mechanism F is configured with a projecting piece 58 formed on the inner surface of the sleeve 55 and an engagement groove 51*g* formed in a groove shape on the outer surface of the bolt body 51 so that this projecting piece 58 is engaged. In this configuration, although the sleeve 55 is relatively non-rotatable around the rotary shaft core X to the bolt body 51, each is relatively movable in the direction along the rotary shaft core X.

By this configuration, since the pressure of the hydraulic oil of the inside space of the shaft 5T is applied to the inner end side of the sleeve 55, the sleeve 55 is displaced in the direction of the bolt head 52. Therefore, the end portion of the projecting side of the sleeve 55 comes in close contact with the rear surface of the bolt head 52. Thereby, the sealing performance of the close contact surface is improved, without using the oil seal.

(c) As the regulation mechanism F, a configuration that a bolt inserted to a hole portion which passes through in the radial direction with respect to the sleeve 55 being screwed to the bolt body 51 may be adopted.

The embodiment disclosed here may be used for the valve opening and closing timing control apparatus setting the valve opening and closing timing by a fluid pressure.

A valve opening and closing timing control apparatus according to an aspect of this disclosure may include a driving side rotor that synchronously rotates with a crankshaft of an internal combustion engine, a driven side rotor that is disposed at a coaxial core with a rotary shaft core of the driving side rotor and integrally rotates with a camshaft for a valve opening and closing, a connecting bolt that is disposed at the coaxial core with the rotary shaft core to connect the driven side rotor to the camshaft, and on which an advance angle port communicating with an advance angle chamber partitioned between the driving side rotor and the driven side rotor and a retard angle port communicating with a retard angle chamber partitioned between the driving side rotor and the driven side rotor are formed on an outer peripheral surface, and a spool that is disposed in a spool chamber of the inside of the connecting bolt, and controls the feeding and discharging of working fluid to the advance angle port or the retard angle port from a pump port formed on the connecting bolt. The connecting bolt may be configured to include a bolt body to be connected to the driven side rotor and a sleeve externally fitting to the bolt body. The pump port may be formed as a through hole over the spool chamber and the outer peripheral surface on the bolt body, and the advance angle port and the retard angle port may be formed as a through hole over the bolt body and the sleeve. An inside space of the shaft to which the working fluid may be supplied from a fluid pressure pump is formed in the camshaft, and one end portion of the sleeve of the connecting bolt to be connected to the camshaft is exposed to the inside space of the shaft. An introduction flow passage for supplying the working fluid from the inside space of the shaft to the pump port may be formed to a region avoiding the advance angle port and the retard angle port on at least any one of an inner peripheral surface of the sleeve and the outer peripheral surface of the bolt body. The apparatus may further include a regulation mechanism which regulates a posture of rotation around the rotary shaft core of the bolt body and the sleeve, while allowing movement to abut on a portion of the driven side rotor in a direction along the rotary shaft core of the sleeve to the bolt body.

According to the aspect of this disclosure, due to having the regulation mechanism, a position of the introduction flow passage is determined in a rotation direction around the rotary shaft core with respect to the bolt body, and the movement in a direction along the rotary shaft core of the sleeve with respect to the bolt body is allowed. In this configuration, since one end portion of the sleeve is exposed to the inside space of the shaft, a fluid pressure of the inside space of the shaft is applied to one end portion of the sleeve, and the sleeve is moved to the other end portion side by this fluid pressure. Since the sleeve is moved in this manner, for example, until the sleeve abuts on a rear surface of the bolt head of the connecting bolt as a portion of the driven side rotor, the sleeve is moved to be brought into close contact with the surface by the pressure of the fluid pressure. Therefore, without using a seal material, it is possible to suppress a phenomenon in which the working fluid leaks out from the end surface of the sleeve. Specifically, even in the configuration in which the groove-shaped introduction flow passage reaching the other end portion side of the sleeve is formed in the inner surface of the sleeve, satisfactory sealing performance is realized.

Accordingly, the valve opening and closing timing control apparatus satisfactorily suppressing the leakage of the working fluid is configured.

In the aspect of this disclosure, the regulation mechanism may include a first engagement portion formed on the bolt body, a second engagement portion formed on the sleeve, and an engagement member engaged with these portions, and a gap to allow relative movement in a direction along the rotary shaft core of the bolt body and the sleeve may be formed between the first engagement portion and the engagement member or between the second engagement portion and the engagement member.

According to the aspect of this disclosure with this configuration, for example, the configuration engaging the pin-shaped engagement member over the first engagement portion formed in the bolt body and the second engagement portion formed in the sleeve, allows the relative movement of the bolt body and the sleeve. Therefore, it is possible to determine the posture of rotation around the rotary shaft core of the bolt body and the sleeve.

In the aspect of this disclosure, the first engagement portion may be formed as a bag-shaped hole with respect to the outer surface of the bolt body.

For example, compared with when the first engagement portion is formed with the through hole, when the first engagement portion is formed in a recessed shape, in a case where the engagement member is press-fitted into a first engagement hole, shaving powder from the inside of the first engagement hole does not leak into an internal space of the spool chamber formed in the bolt body.

In the aspect of this disclosure, a retainer receiving a biasing force of a spring projecting and biasing the spool may be press-fitted and fixed to the spool chamber, and the first engagement portion may be disposed at a position deviated in the direction along the rotary shaft core from the position to which the retainer is press-fitted and fixed.

According to the aspect of this disclosure with this configuration, even if a portion of the bolt body is deformed by the pressure when the retainer is press-fitted into the internal space, the deformation of the first engagement portion may be suppressed. Therefore, variation of the engagement position of the engagement member or inconvenience in which the engagement member is incapable of engaging with the first engagement portion does not occur.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve opening and closing timing control apparatus comprising:

a driving side rotor that synchronously rotates with a crankshaft of an internal combustion engine;

a driven side rotor that is disposed at a coaxial core with a rotary shaft core of the driving side rotor and integrally rotates with a camshaft for a valve opening and closing;

a connecting bolt that is disposed at the coaxial core with the rotary shaft core to connect the driven side rotor to the camshaft, and on which an advance angle port communicating with an advance angle chamber partitioned between the driving side rotor and the driven side rotor and a retard angle port communicating with a retard angle chamber partitioned between the driving side rotor and the driven side rotor are formed on an outer peripheral surface; and a spool that is disposed in a spool chamber of the inside of the connecting bolt, and controls the feeding and discharging of working fluid to the advance angle port or the retard angle port from a pump port formed on the connecting bolt, wherein the connecting bolt is configured to include a bolt body to be connected to the driven side rotor and a sleeve externally fitting to the bolt body, wherein the pump port is formed as a through hole over the spool chamber and the outer peripheral surface on the bolt body, and the advance angle port and the retard angle port are formed as a through hole over the bolt body and the sleeve, wherein an inside space of the camshaft to which the working fluid is supplied from a fluid pressure pump is formed in the camshaft, and one end portion of the sleeve of the connecting bolt to be connected to the camshaft is exposed to the inside space of the camshaft, wherein an introduction flow passage for supplying the working fluid from the inside space of the camshaft to the pump port is formed to a region avoiding the advance angle port and the retard angle port on at least any one of an inner peripheral surface of the sleeve and the outer peripheral surface of the bolt body, wherein a regulation mechanism is provided which regulates a posture of rotation around the rotary shaft core of the bolt body and the sleeve, while allowing movement to abut on a portion of the driven side rotor in a direction along the rotary shaft core of the sleeve to the bolt body, wherein the regulation mechanism includes a first engagement portion formed on the bolt body, a second engagement portion formed on the sleeve, and a engagement member engaged with the first engagement portion and the second engagement portion, and wherein a gap to allow relative movement in a direction along the rotary shaft core of the bolt body and the sleeve is formed between the first engagement portion and the engagement member or between the second engagement portion and the engagement member.

2. The valve opening and closing timing control apparatus according to claim 1, wherein the first engagement portion is formed as a bag-shaped hole with respect to the outer surface of the bolt body.

3. The valve opening and closing timing control apparatus according to claim 2, wherein a retainer receiving a biasing force of a spring projecting and biasing the spool is press-fitted and fixed to the spool chamber, and the first engagement portion is disposed at a position deviated in the direction along the rotary shaft core from the position to which the retainer is press-fitted and fixed.

4. The valve opening and closing timing control apparatus according to claim 1, wherein a retainer receiving a biasing force of a spring projecting and biasing the spool is press-fitted and fixed to the spool chamber, and the first engagement portion is disposed at a position deviated in the direction along the rotary shaft core from the position to which the retainer is press-fitted and fixed.

5. The valve opening and closing timing control apparatus according to claim 1, wherein the engagement member comprises an engagement pin.

* * * * *